United States Patent [19]

Hamada et al.

[11] Patent Number: 4,466,881

[45] Date of Patent: Aug. 21, 1984

[54] PROCESS FOR THE PREPARATION OF (ω-FLUOROSULFONYL)HALOALIPHATIC CARBOXYLIC ACID FLUORIDES

[75] Inventors: Masato Hamada; Jukichi Ohmura, both of Yokohama; Fumio Muranaka, Kawasaki, all of Japan

[73] Assignee: Asahi Kasei Kogyo Kabushiki Kaisha, Osaka, Japan

[21] Appl. No.: 493,946

[22] Filed: May 12, 1983

Related U.S. Application Data

[63] Continuation-in-part of Ser. No. 360,676, Mar. 22, 1982, Pat. No. 4,425,199.

[30] Foreign Application Priority Data

Apr. 2, 1981 [JP] Japan ..... 56-48383

[51] Int. Cl.[3] ..... C25C 1/00; C25C 3/00

[52] U.S. Cl. ..... 204/59 F

[58] Field of Search ..... 204/59 F

[56] References Cited

U.S. PATENT DOCUMENTS

| | | | |
|---|---|---|---|
| 2,519,983 | 8/1950 | Simons | 204/59 F |
| 2,593,737 | 4/1952 | Diesslin et al. | 204/59 F |
| 2,732,398 | 1/1956 | Brice et al. | 204/59 F |
| 3,028,321 | 4/1962 | Danielson et al. | 204/59 F |
| 4,329,435 | 5/1982 | Kimoto et al. | 204/59 F |

FOREIGN PATENT DOCUMENTS

| | | |
|---|---|---|
| 1099240 | 1/1968 | United Kingdom . |

*Primary Examiner*—John F. Niebling

*Attorney, Agent, or Firm*—Birch, Stewart, Kolasch & Birch

[57] ABSTRACT

A novel process is disclosed for preparing (ω-fluorosulfonyl)haloaliphatic carboxylic acid fluorides by electrolytic fluorination, simply and efficiently.

4 Claims, No Drawings

PROCESS FOR THE PREPARATION OF (ω-FLUOROSULFONYL)HALOALIPHATIC CARBOXYLIC ACID FLUORIDES

This application is a continuation-in-part of our U.S. Application Ser. No. 360,676 filed Mar. 22, 1982, now U.S. Pat. No. 4,425,199.

This invention relates to a process for the preparation of (ω-fluorosulfonyl) haloaliphatic carboxylic acid fluorides, and more particularly to a process for the preparation of the same, which enables the desired products to be obtained simply and efficiently.

Perfluoro compounds and fluoro compounds having a carboxylic acid group or a sulfonic acid group are widely used as starting materials for the manufacture of surface active agents, lubricants, water repellents and oil repellents, and it is known that these compounds are prepared by electrolytic fluorination.

However, the preparation of perfluoro compounds and fluoro compounds having both a carboxylic acid group or a group derived therefrom and a sulfonic acid group or a group derived therefrom has seldom been reported. Mentioned in the specification of U.S. Pat. No. 2,852,554 is a process for the preparation of fluorosulfonyldifluoroacetyl fluoride ($FSO_2CF_2COF$), in which the desired compound is prepared by utilizing the addition reaction with tetrafluoroethylene. Further, the processes for the preparation of $FSO_2(CF_2)_nCOF$ in which n is at least 2 are disclosed in Japanese Patent Application Laid-Open Specifications No. 160008/80 and No. 160030/80, but these processes include a great number of steps and require complicated reactions.

The present inventors made extensive and intensive researches with a view to developing a new process for preparing the foregoing compounds at high efficiency by a small number of steps, and as a result, they have succeeded in developing a process for preparing (ω-fluorosulfonyl)haloaliphatic carboxylic acid fluorides conveniently with ease.

More specifically, in accordance with the present invention, there is provided a process for the preparation of an (ω-fluorosulfonyl)haloaliphatic carboxylic acid fluoride which comprises subjecting to electrolysis an electrolyte comprising at least one compound selected from the group consisting of compounds represented by the following general formulae:

$$YS(=O)_2(CX_1X'_1CX_2X'_2\ldots CX_nX'_n)COY', \quad (1)$$

$$Y''S(=O)_2(CX_1X'_1CX_2X'_2\ldots CX_n X'_n)CH_2OH \quad (2)$$

and $$[YS(=O)_2(CX_1X'_1CX_2X'_2\ldots CX_nX'_n)CO]_2O \quad (3)$$

wherein n is an integer of from 1 to 4, $X_1$ through $X_n$ and $X'_1$ through $X'_n$ each independently stand for H, Cl or F, Y stands for an alkyl group having 1 to 8 carbon atoms, OH, Cl, F or OR in which R stands for an alkyl group having 1 to 8 carbon atoms, Y' stands for Cl, F, OH or OR' in which R' stands for an alkyl group having 1 to 8 carbon atoms, and Y'' stands for Y or OM in which M stands for an alkali metal, and liquid hydrogen fluoride in an electrolytic cell to effect electrolytic fluorination of said at least one compound, thereby to obtain an (ω-fluorosulfonyl)haloaliphatic carboxylic acid fluoride represented by the following general formula:

$$FSO_2(CZ_1Z'_1CZ_2Z'_2\ldots CZ_nZ'_n)COF$$

wherein $Z_1$ through $Z_n$ and $Z'_1$ through $Z'_n$ each independently stand for F or Cl, and n is an integer of from 1 to 4.

From the viewpoint of the reactivity, especially of the yield, it is preferred that a compound of the formula(1) in which Y is Cl or F and Y' is Cl or F, a compound of the formula(3) in which Y is Cl or F or a compound of the formula(2) in which Y'' stands for Cl, F, OH or ONa be used as the starting compound. From the viewpoint of the availability, it is preferred that a compound of the formula(1) in which Y stands for Cl or OH and Y' stands for Cl or OH or a compound of the formula(2) in which Y'' stands for OH or ONa be used as the starting compound. If both the yield and the availability are taken into account, a compound of the formula(2) in which Y'' stands for OH or ONa are especially preferred.

As preferred examples of the starting compound, there can be mentioned 2-hydroxyethanesulfonic acid, sodium 2hydroxyethanesulfonate, 3-hydroxypropanesulfonic acid, sodium 3-hydroxypropanesulfonate, 4-hydroxybutanesulfonic acid, sodium 4-hydroxybutanesulfonate, 5-hydroxypentanesulfonic acid, sodium 5-hydroxypentanesulfonate, 2-chlorosulfonylacetyl chloride, 3-chlorosulfonylpropionic acid chloride, 4-chlorosulfonylbutyric acid chloride, 5-chlorosulfonylpentanoic acid chloride, 2-sulfoacetic acid, 3-sulfopropionic acid, 4-sulfobutyric acid and 5-sulfopentanoic acid.

In practicing the process of the present invention, the starting compound is added into liquid hydrogen fluoride and preferably dissolved therein, and the starting compound is electrolytically fluorinated.

The electrolytic fluorination can be carried out at a starting compound concentration in the electrolyte of 1 to 90% by weight. However, too high a concentration of the starting compound results in increase of electrolytic voltage, and decomposition reactions of the unreacted starting compound, intermediate compound and desired compound are readily caused at a high starting compound concentration. On the other hand, too low a concentration of the starting compound results not only in a decrease of current efficiency but also in a disadvantageous increase of the volume of electrolyte. Therefore, it is advantageous that the starting compound concentration to 3 to 70% by weight. A current density of 0.01 to 10 $A/dm^2$ may ordinarily be adopted. However, if the current density is high, the electrolytic voltage is increased and side reactions are readily caused. Accordingly, it is advantageous that the electrolytic fluorination be carried out at a current density of 0.1 to 5 $A/dm^2$. The electrolytic temperature is −20° to 80° C. and preferably −20° to 50° C. If the fluorination is continued after the formation of the intended product, the intended product once formed is further fluorinated to form various decomposition products via complicated routes. For this reason, accumulation of the formed intended product in an electrolytic cell is not preferred. Accordingly, it is advantageous that the electrolytic temperature be relatively high and the formed intended product be successively withdrawn from the electrolyic cell. At too low a temperature, the electrolytic voltage is apt to increase. At too high a temperature, not only side reactions are readily caused but also hydrogen fluoride escapes, and, in addition, in the case where a compound having a relatively low boiling point is electrolytically fluorinated, the starting compound is likely to escape from the electrolytic cell before the reaction is completed. Ordinarily, the electrolysis is carried out under atmospheric pressure, but an elevated pressure may be adopted according to need. When the electrolysis is carried out under an elevated pressure, it is advantageous that the electrolysis be conducted under a pressure lower than 760 mmHg-gauge.

The electrolysis time may, in general, be such that an electric current is caused to flow in a quantity of 1 to 200% based on the electricity quantity which is theoretically required for completion of the reaction (hereinafter referred to as "theoretical electricity quantity"). On one hand, in the present invention, the electrolysis may be conducted according to a batchwise process. In the batchwise process, it is ordinarily advantageous that the electrolysis time be such that an electric current is caused to flow in a quantity of 80 to 200% of the theoretical electricity quantity. On the other hand, in the present invention, the electrolysis may be conducted in a continuous manner in which an electrolysis is conducted while supplying a starting compound and a reactant to the electrolytic cell. When the electrolysis is conducted in a continuous manner, it is advantageous that the electrolysis be conducted while keeping the electrolyte to have a composition obtained at the time of current-flowing at an electricity quantity of 40% to 110% based on the theoretical electricity quantity. In the electrolysis of the process of the present invention, when the electricity quantity is in the range of 40% to 110% based on the theoretical electricity quantity, there unexpectedly appears a point showing a maximum selectivity in such a range of electricity quantity. In such electricity quantity range, the selectivity is as high as about 50% or more based on the maximum selectivity. The selectivity as high as about 50% or more based on the maximum selectivity is desirable from a practical point of view. By effecting continuously the electrolysis while keeping the electrolyte to have a composition obtained at the time of current-flowing at such a range of electricity quantity, a high selectivity can be maintained during the whole course of the electrolysis, resulting in higher yield than that obtained by the electrolysis conducted according to the batchwise process.

An explanation will now be given on the manner of keeping an electrolyte composition obtained at the time of current-flowing at an electricity quantity of 40% to 110% based on the theoretical electricity quantity (such composition is hereinafter often referred to simply as "40 to 110% electricity quantity composition"). When one wishes to conduct an electrolysis in a continuous manner while keeping the electrolyte to have a composition obtained at the time of current-flowing at a predetermined electricity quantity falling in the range of electricity quantity of 40% to 110% based on the theoretical electricity quantity, first, an electrolysis is conducted according to the batchwise process to determine a rate of consumption of the starting compound in the electrolyte obtained at the time of current-flowing at the above predetermined electricity quantity (such rate of consumption of the starting compound is hereinafter referred to simply as "rate of consumption of the starting compound at the predetermined electricity quantity"). Illustratively stated, after charging hydrogen fluoride as well as at least one compound (as a starting compound) selected from the compounds represented by the formulae(1), (2) and (3) as described above into an electrolytic cell, an electrolysis is started. A portion of the electrolyte in the cell is withdrawn from the cell when the electricity quantity has reached the predetermined electricity quantity. Further, a predetermined period of time later, for example, one hour later, a portion of the electrolyte in the cell is withdrawn. The compositions of the obtained two sample portions are determined by gas chromatography to obtain the amount of the starting compound consumed during the above period, thus obtaining the rate of consumption of the starting compound, which is defined as the rate of consumption of the starting compound at the predetermined electricity quantity. Thus, there is obtained a rate of consumption of the starting compound at the predetermined electricity quantity. In practicing the process of the present invention in a continuous manner, the above-obtained rate of consumption of the starting compound is utilized so that the continuous electrolysis can be easily conducted while keeping the electrolyte to have a 40 to 100% electricity quantity composition. That is, in the continuous electrolysis, when the electricity quantity has reached the predetermined electricity quantity, the starting material is supplied into the cell at a rate such that the rate of feed of the starting compound is equal to the rate of comsumption of the starting compound. The supply of the starting compound may be effected by intermittently adding the starting compound at predetermined time intervals or continuously adding the starting compound by means of a pump. While an electrolysis is conducted while keeping the electrolyte to have a 40 to 100% electricity quantity composition, the composition of the electrolyte may be monitered. If the composition of the electrolyte deviates from the intended composition by accident, the composition of the electrolyte can be adjusted by increasing or decreasing the rate of feed of the starting compound according to the monitering. With respect to hydrogen fluoride in the electrolyte, since the proportion of hydrogen fluoride in the electrolyte is very large as compared with that of the starting compound, small change in the proportion of hydrogen fluoride in the electrolyte does not actually affect the composition as a whole. So, it is not necessary to determine the rate of consumption of the hydrogen fluoride, but sufficient to occasionally supply hydrogen fluoride into the electrolytic cell in such an amount as will maintain the electrolyte at a predetermined level.

As mentioned above, in the electrolysis of the process of the present invention, when the electricity quantity is in the range of 40% to 110% based on the theoretical electricity quantity, there appears a point showing a maximum selectivity. Such a point showing a maximum selectivity can be easily obtained by a graph showing the relationship between the selectivity and the proportion (%) of the electricity quantity (A·hr) to the theoretical electricity quantity (A·hr). The above-mentioned graph can be obtained as follows. After charging hydrogen fluoride as well as at least one compound selected from the compounds represented by the formulae(1), (2)

and (3) as described above into an electrolytic cell, the electrolysis is conducted according to the batchwise process. During the electrolysis, the gas mixture formed by the electrolysis and containing an intended product is analyzed by gas chromatography to determine the selectivity at predetermined time intervals and the obtained selectivities are plotted against the proportion (%) of the electricity quantity (A·hr) to the theoretical electricity quantity (A·hr), thereby obtaining a graph showing the relationship between the selectivity and the proportion (%) of the electricity quantity (A·hr) to the theoretical electricity quantity (A·hr). As a result, the electricity quantity corresponding to the maximum selectivity is determined.

In the present invention, it is preferable that an electrolysis be conducted while keeping the electrolyte to have a composition obtained at the time of current-flowing at an electricity quantity of 40% to 110% based on the theoretical electricity quantity. It is most preferable that an electrolysis be conducted while keeping the electrolyte to have a composition obtained at the time of current-flowing at an electricity quantity corresponding to the maximum selectivity.

As mentioned above, the rate of consumption of the starting compound at a predetermined electricity quantity and the electricity quantity corresponding to the maximum selectivity may be obtained according to the batchwise process. When one wishes to conduct an electrolysis while keeping the electrolyte to have a composition obtained at the time of current-flowing at an electricity quantity corresponding to the maximum selectivity, the electricity quantity corresponding to the maximum selectivity and the rate of consumption of the starting compound at the electricity quantity corresponding to the maximum selectivity may be obtained beforehand according to the batchwise process and, using these data, an electrolysis may be conducted in a continuous manner while keeping the electrolyte to have a composition obtained at the time of current-flowing at an electricity quantity corresponding to the maximum selectivity. However, it is not always necessary to use the batchwise process for determining the electricity quantity corresponding to the maximum selectivity and the rate of consumption of the starting compound at the electricity quantity corresponding to the maximum selectivity. It is possible to obtain such data during the course of effecting an electrolysis in a continuous manner. Illustratively stated, during the continuous electrolysis, the gas mixture formed by the electrolysis may be analyzed by gas chromatography to determine the selectivity at predetermined time intervals and, at the same time, the electrolyte in the cell may be analyzed by gas chromatography to determine the composition of the electrolyte. When the selectivity has reached a maximum point, the rate of consumption of the starting material in the electrolyte obtained at the time of the current-flowing at the electricity quantity corresponding to the maximum selectivity is determined in the same manner as mentioned above with respect to the determination of the rate of consumption of the starting compound at a predetermined electricity quantity. Then, while supplying the starting compound into the cell so that the electrolyte composition obtained at the time of current-flowing at an electricity quantity corresponding to the maximum selectivity is maintained, the electrolysis may be conducted in a continuous manner. Thus, an electrolysis can be conducted in a continuous manner while keeping the electrolyte to have a composition obtained at the time of current-flowing at the electricity quantity corresponding to the maximum selectivity, even if the batchwise process is not used to determine the electricity quantity corresponding to the maximum selectivity and the rate of consumption of the starting compound at the electricity quantity corresponding to the maximum selectivity.

The foregoing reaction conditions vary according to the kind of the starting compound to be fluorinated, and preferred conditions may be optionally selected, taking into consideration such factors as the yield of the intended product, current efficiency and power consumption.

If the content in the electrolytic cell is stirred during the electrolysis, the yield of the intended compound can be increased while reducing the amounts of by-products. For this purpose, there may be adopted a method in which mechanical forcible stirring is performed, a method in which stirring is carried out while introducing an inert gas such as nitrogen gas and/or a method in which the electrolyte is circulated. Furthermore, the yield of the intended compound can be increased and formation of an oxidized fluorine compound which is explosive can be controlled if water is removed from the charge in the electrolytic cell. In order to remove water, it is preferred that hydrofluoric acid to be used for the reaction be preliminarily electrolyzed or the starting compound to be fluorinated be sufficiently dried.

In the present invention, an additive may be added so as to improve the selectivity to the intended compound. For example, an unsaturated cyclic sulfone such as sulfolene or a derivative thereof (reference may be made to British Patent Specification No. 1,413,011); a metal fluoride such as NaF, KF, LiF, AgF, $CaF_2$ or $AlF_3$; ammonia; an organic acid such as acetic acid or propionic acid; an alcohol such as ethanol; diethyl ether; or pyridine may be used as the additive. Furthermore, a conductive agent may be added so as to reduce the electrolytic voltage. Sodium fluoride or other conductive agent customarily used for electrolytic fluorination may be used in the present invention.

The intended (ω-fluorosulfonyl)haloaliphatic carboxylic acid fluoride sometimes escapes from the electrolytic cell in such a form as is entrained by an inert gas when the inert gas is introduced for stirring or as entrained by a gas mixture formed by the electrolysis. Since the intended compound is apt to form an azeotropic mixture with hydrofluoric acid, lowering of the boiling point is readily caused. Therefore, a compound having a relatively small carbon number tends to be easily discharged from the electrolytic cell. In order to prevent excessive fluorination of the intended product, however, it is preferred to positively withdraw the intended product. When the intended product is entrained by the gas or gas mixture, there may be adopted a method in which the resulting gas mixture is passed through a layer of pellets of sodium fluoride to remove hydrofluoric acid and the intended compound is collected by a trap. In case the intended product is left in the electrolytic cell, the intended product is not dissolved in liquid hydrogen fluoride but is present in a separate layer. After the electrolysis, this layer of the intended compound may be withdrawn, purified and used.

In the present invention, an ordinary electrolytic fluorination cell provided with anodes and cathodes each made of nickel or a nickel alloy may be used as the electrolytic cell.

According to the present invention, (ω-fluorosulfonyl)haloaliphatic carboxylic acid fluorides can be advantageously obtained with ease. These compounds are very valuable as starting materials for the manufacture of oil repellents, water repellents, surface active agents, ion exchange membranes, resins and the like.

The present invention will now be described in detail with reference to the following Examples that by no means limit the scope of the present invention.

COMPARATIVE EXAMPLE 1

In an electrolytic cell made of a Monel metal, seven anodes and eight cathodes, each being formed of a nickel plate, were alternately arranged so that the distance between every two adjacent electrodes was 2 mm and the effective current-flowing area was 7.2 $dm^2$.

The electrolytic cell was charged with 500 ml of anhydrous hydrofluoric acid, and minute amounts of impurities were removed by preliminary electrolysis. Then, a solution of 28.3 g of methyl 3-methylsulfonyltetrafluoropropionate in an equiamount by weight of anhydrous hydrofluoric acid which had previously been subjected to preliminary electrolysis (in all the following Examples and Reference Examples, a preliminary electrolysis-treated anhydrous hydrofluoric acid was similarly used) was introduced into the electrolytic cell. The electrolysis was carried out under conditions of an anode current density of 2.08 $A/dm^2$, an electrolyte temperature of 5° to 6° C., an electrolytic voltage of 6.4 V and a current quantity of 57.5 A·hr.

The gas mixture formed by the electrolysis was passed through a sodium fluoride pipe to remove entrained hydrogen fluoride and was then collected in a trap cooled to −78° C. by dry ice-acetone. When the collected liquid was subjected to fractional distillation, 4.8 g of perfluoro(3-fluorosulfonyl)propionic acid fluoride having a boiling point of 52° C. was obtained as the desired compound (yield: 17.6%).

The compound was identified by the infrared absorption spectrum and nuclear magnetic resonance spectrum.

In the infrared absorption spectrum, there were observed an absorption of $\lambda max = 5.3\mu$ due to the group $$-\overset{\overset{\displaystyle O}{\|}}{C}-F$$

and an absorption of $\lambda max = 6.8\mu$ due to the group $$-\overset{\overset{\displaystyle O}{\|}}{\underset{\underset{\displaystyle O}{\|}}{S}}-F.$$

In the same manner as described above, isethionic acid, 3-ethylsulfonyltetrafluoropropionic acid chloride, 3-methylsulfonyltetrafluoropropionic acid anhydride and chlorosulfonylpropionic acid chloride were electrolytically fluorinated. The obtained results including the above-obtained results are shown in Table 1.

The obtained amount and yield of each of the intended compounds were determined by gas chromatography of the collected product.

TABLE 1

| Run No. | 1 | 2 | 3 |
|---|---|---|---|
| Starting Compound, (g) | $CH_3SO_2CF_2CF_2CO_2CH_3$, 28.3 | $HO_3SCH_2CH_2OH$, 25.2 | $C_2H_5SO_2CF_2CF_2COCl$, 25.7 |
| Temperature (°C.) | 5~6 | −5~0 | 10 |
| Current Density ($A/dm^2$) | 2.08 | 2.08 | 2.08 |
| Voltage (V) | 6.4 | 6.2 | 6.5 |
| Power Consumption (A · hr) | 57.5 | 70.8 | 35.4 |
| Ratio (%) of Power Consumption to Theoretical Value | 129 | 110 | 110 |
| Intended Product | $FO_2SCF_2CF_2COF$ | $FO_2SCF_2COF$ | $FO_2SCF_2CF_2COF$ |
| Amount Obtained (g) | 4.8 | 5.5 | 5.4 |
| Yield (%) | 17.6 | 15.4 | 23.5 |

| Run No. | 4 | 5 |
|---|---|---|
| Starting Compound, (g) | $(CH_3SO_2CF_2CF_2CO)_2O$, 21.5 | $ClO_2SCH_2CH_2COCl$, 38.2 |
| Temperature (°C.) | 10 | 10 |
| Current Density ($A/dm^2$) | 1.0 | 0.5 |
| Voltage (V) | 6.3 | 4.9 |
| Power Consumption (A · hr) | 29.5 | 60.0 |
| Ratio (%) of Power Consumption to Theoretical Value | 110 | 140 |
| Intended Product | $FO_2SCF_2CF_2COF$ | $FO_2SCF_2CF_2COF$ |
| Amount Obtained (g) | 2.6 | 29.9 |
| Yield (%) | 11.0 | 65.0 |

COMPARATIVE EXAMPLE 2

In the electrolytic cell as described in Comparative Example 1 was charged 500 ml of anhydrous hydrofluoric acid, and preliminary electrolysis was conducted to remove minute amounts of impurities. A solution of 48.6 g (0.3 mol) of sodium 3-hydroxy-1-propanesulfonate in an equiamount by weight of anhydrous hydrofluoric acid was then added into the electrolytic cell. The electrolysis was carried out at an anode current density of 0.05 A/dm$^2$, an electrolyte temperature of 14° to 15° C. and an electrolytic voltage of 5.1 V. The current quantity was 153.0 A·hr, and the electrolytic voltage was increased to 6.7 V.

The gas mixture formed by the electrolysis was passed through a sodium fluoride pipe to remove entrained hydrogen fluoride and was then collected in a trap cooled to −78° C. by dry ice-acetone. The collected liquid was subjected to fractional distillation to obtain 32.7 g of perfluoro(3-fluorosulfonyl)propionic acid fluoride. The yield was 47.5%.

EXAMPLE 1

In the electrolytic cell as described in Comparative Example 1 was charged 500 ml of anhydrous hydrofluoric acid, and preliminary electrolysis was conducted to remove minute amounts of impurities. A solution of 47.6 g (0.2 mol) of methyl 3-methylsulfonyltetrafluoropropionate in an equiamount by weight of anhydrous hydrofluoric acid was then added into the electrolytic cell. The electrolysis was carried out at an anode current density of 2.0 A/dm$^2$ and an electrolyte temperature of 9° to 10° C. The gas mixture formed by the electrolysis and containing the intended product was analyzed by gas chromatography to determine selectivity at predetermined time intervals and the selectivity was plotted against the proportion (%) of the electricity quantity (A·hr) to the theoretical electricity quantity (A·hr), thereby obtaining a graph showing the relationship between the selectivity and the proportion (%) of the electricity quantity (A·hr) to the theoretical electricity quantity (A·hr). There was observed a maximum selectivity at an electricity quantity of 100% based on the theoretical electricity quantity. In conducting the electrolysis, a portion of the electrolyte in the cell was withdrawn when the proportion (%) of the electricity quantity to the theoretical electricity quantity reached the proportion of the electricity quantity to the theoretical electricity quantity exhibiting a maximum selectivity. Further, one hour later, a portion of the electrolyte in the cell was withdrawn. The rate of consumption of methyl 3-methylsulfonyltetrafluoropropionate observed at an electricity quantity of 100% based on the theoretical electricity quantity was 15.2 g/2 hours.

Using the above-obtained data with respect to the electricity quantity corresponding to the maximum selectivity and the rate of consumption of the starting compound, an electrolysis was conducted in a continuous manner as follows.

In the electrolytic cell as described in Comparative Example 1 was charged 500 ml of anhydrous hydrofluoric acid, and preliminary electrolysis was conducted to remove minute amounts of impurities. A solution of 47.6 g (0.2 mol) of methyl 3-methylsulfonyltetrafluoropropionate in an equi-weight amount of anhydrous hydrofluoric acid was then added into the electrolytic cell. The electrolysis was carried out at an anode current density of 2.0 A/cm$^2$ and an electrolyte temperature of 9° to 10° C. When the electricity quantity reached an electricity quantity of 100% of the theoretical electricity quantity for the charged methyl 3-methylsulfonyltetrafluoropropionate (75.1 A·hr), 15.2 g of methyl 3-methylsulfonyltetrafluoropropionate was additionally charged into the electrolytic cell every two hours. Anhydrous hydrofluoric acid was additionally charged into the electrolytic cell from time to time so that the electrodes were completely immersed in the electrolyte. The electrolysis was further conducted 100 hours after the start of additional charging of the starting compound. The electrolytic voltage during this period was 6.1 to 6.3 V. The gas mixture formed by the electrolysis was passed through a sodium fluoride pipe to remove entrained hydrogen fluoride and was then collected in a trap cooled to −78° C. by dry ice-acetone. When the collected liquid was subjected to fractional distillation, perfluoro(3-fluorosulfonyl)propionic acid fluoride having a boiling point of 52° C. was obtained as the desired compound. The amount of perfluoro(3-fluorosulfonyl)-propionic acid fluoride produced after the start of addition of the starting material was 426 g. The yield based on the additionally charged starting compound was 58%.

EXAMPLE 2

In the same manner as described in Example 1, isethionic acid, 3-ethylsulfonyltetrafluoropropionic acid chloride, 3-methylsulfonyltetrafluoropropionic acid anhydride and chlorosulfonylpropionic acid chloride were electrolytically fluorinated in a continuous manner. The obtained results are shown in Table 2.

The obtained amount and yield of each of the intended compounds were determined by gas chromatography of the collected product.

TABLE 2

| Run No. | 6 | 7 | 8 | 9 |
|---|---|---|---|---|
| Starting Compound | $HO_3SCH_2CH_2OH$ | $C_2H_5SO_2CF_2CF_2COCl$ | $(CH_3SO_2CF_2CF_2CO)_2O$ | $ClO_2SCH_2CH_2COCl$ |
| Temperature (°C.) | 9–10 | 9–10 | 9–10 | 9–10 |
| Current Density (A/dm$^2$) | 2.0 | 2.0 | 2.0 | 2.0 |
| Voltage (V) | 5.9–6.2 | 6.0–6.3 | 6.2–6.4 | 5.8–6.1 |
| Amount of additionally charged starting compound (g) | 451 | 957 | 888 | 1069 |
| Proportion of electricity quantity to the theoretical electricity quantity at the time when additional starting compound began to be charged (said proportion corresponds to the maximum selectivity) (%) | 105 | 75 | 80 | 70 |
| Power Consumption after the start of additional charging of starting compound (A · hr) | 1440 | 1440 | 1440 | 1440 |
| Intended Product | $FO_2SCF_2COF$ | $FO_2SCF_2CF_2COF$ | $FO_2SCF_2CF_2COF$ | $FO_2SCF_2CF_2COF$ |
| Amount of intended product obtained after the start of additional charging of starting compound (g) | 356 | 517 | 243 | 931 |
| Yield (%) | 55.3 | 60.2 | 51.2 | 72.3 |

EXAMPLE 3

In an electrolytic cell made of SUS 316L, ten anodes and eleven cathodes, each being formed of a nickel plate, were alternately arranged so that the effective current-flowing area was 16 $dm^2$ and the distance between every two adjacent electrodes was 2.0 mm. A feed tank was disposed, and the electrolysis was carried out while circulating the electrolyte by means of a circulating pump.

First, 3.0 kg of an anhydrous hydrofluoric acid solution having a methyl 3-methylsulfonyltetrafluoropropionate concentration of 17% by weight was charged in the feed tank and the solution was circulated at a flow rate of 1.0 liter/min and the electrolysis was carried out at a current density of 2.0 $A/dm^2$ and a temperature of 10° to 12° C. When the current quantity was 40% of the theoretical electricity quantity for the charged starting compound (315 A·hr), the electrolysis was stopped. At this point, the anhydrous hydrofluoric acid solution contained the starting compound at a concentration of 6.9% by weight and partially fluorinated intermediates at a concentration of 7.9% by weight, while 38.6 g of the intended perfluoro(3-fluorosulfonyl)propionic acid fluoride was collected in a cooling trap. The current efficiency with respect to the total of the intermediate and the formed acid fluoride was 60%.

Then, the electrolysis was further conducted by using the so obtained electrolyte. In order to maintain the starting compound concentration at 6.9% as precisely as possible, the starting compound was continuously added according to the consumption rate of the starting compound. The electrolysis was conducted for 300 hours in a continuous manner, and the amount of the starting compound added during this period was 5070 g as a whole. The anhydrous hydrofluoric acid solution left after termination of the electrolysis contained the starting compound at a concentration of 7.2% by weight and the intermediate at a concentration of 8.4% by weight. The obtained amount of the intended compound was 2905 g. From these data, it was confirmed that the yield was 59.3 mol % based on the starting compound added and the current efficiency was 49.4%.

REFERENCE EXPERIMENT

The electrolytic cell as described in Comparative Example 1 was charged with 500 ml of anhydrous hydrofluoric acid and preliminary electrolysis was conducted to remove minute amounts of impurities. 46 g of perfluoro(3-fluorosulfonyl)propionic acid fluoride was then charged in the electrolytic cell, and the electrolysis was carried out at an anode current density of 1.04 $A/dm^2$ and an electrolyte temperature of 13° C. The initial electrolytic voltage of 5.7 V was finally increased to 7.7 V. The current quantity was 30 A·hr.

The gas mixture formed by the electrolysis was passed through a sodium fluoride pipe to remove entrained hydrogen fluoride and was then collected in a trap cooled to −78° C. by dry ice-acetone. The collected liquid was subjected to fractional distillation to recover 9.5 g of the starting perfluoro(3-fluorosulfonyl)propinic acid fluoride and obtain 27.7 g of perfluoroethanesulfonyl fluoride. The starting compound recovery ratio was 20.7% and the ratio of decomposition of the starting acid fluoride to perfluoroethanesulfonyl fluoride was 68.6%.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A process for the continuous preparation of a (ω-fluorosulfonyl)haloaliphatic carboxylic acid fluoride which comprises subjecting to electrolysis an electrolyte comprising at least one compound selected from the group consisting of compounds represented by the following general formulas:

$$YS(=O)_2(CX_1X'_1CX_2X'_2 \ldots CX_nX'_n)COY', \quad (1)$$

$$Y''S(=O)_2(CX_1X'_1CX_2X'_2 \ldots CX_n X'_n)CH_2OH \quad (2)$$

and $$[YS(=O)_2(CX_1X'_1CX_2X'_2 \ldots CX_nX'_n)CO]_2O \quad (3)$$

wherein n is an integer of from 1 to 4, $X_1$ through $X_n$ and $X'_1$ through $X'_n$ each independently is H, Cl or F, Y is an alkyl group having 1 to 8 carbon atoms, OH, Cl, F or OR in which R stands for an alkyl group having 1 to 8 carbon atoms, Y' is Cl, F, OH or OR' in which R' is an alkyl group having 1 to 8 carbon atoms, and Y'' is Y or OM in which M is an alkali metal, provided that in the case of the compounds represented by the above formula (1), $X_1$ through $X_n$, $X'_1$ through $X'_n$, Y and Y' are not F concurrently, and liquid hydrogen fluoride in an electrolytic cell to effect electrolytic fluorination of said at least one compound, thereby obtaining a (ω-fluorosulfonyl)haloaliphatic carboxylic acid fluoride represented by the following general formula:

$$FSO_2(CZ_1Z'_1CZ_2Z'_2 \ldots CZ_nZ'_n)COF$$

wherein $Z_1$ through $Z_n$ and $Z'_1$ through $Z'_n$ each independently is F or Cl, and n is as defined above, said electrolysis being conducted while keeping said electrolyte at a composition obtained at the time the current flows at an electricity quantity of 40% to 110% based on the theoretical electricity quantity.

2. A process according to claim 1, wherein $X_1$ through $X_n$ and $X'_1$ through $X'_n$ each independently stand for H, Y stands for Cl or OH, Y' stands for Cl or OH, and Y'' stands for OH or ONa.

3. A process according to claim 1, wherein the electrolysis is conducted while successively withdrawing from the electrolytic cell the (ω-fluorosulfonyl)haloaliphatic carboxylic acid fluoride formed.

4. A process according to claim 1, wherein the electrolysis is conducted at an electrolytic temperature of −10° to 50° C. and a current density of 0.1 to 5 $A/dm^2$.

* * * * *